US012516845B2

(12) United States Patent
Forman et al.

(10) Patent No.: US 12,516,845 B2
(45) **Date of Patent: *Jan. 6, 2026**

(54) ADJUSTABLE AUTOMATIC AIRFLOW CONTROL DAMPER SYSTEM

(71) Applicant: Suncourt, Inc., Durant, IA (US)

(72) Inventors: David J Forman, Coralville, IA (US); Eric Langstengel, Iowa City, IA (US)

(73) Assignee: Suncourt, Inc., Durant, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/387,163

(22) Filed: Nov. 6, 2023

(65) Prior Publication Data

US 2024/0142134 A1 May 2, 2024

Related U.S. Application Data

(63) Continuation of application No. 16/433,785, filed on Jun. 6, 2019, now Pat. No. 11,808,479.

(60) Provisional application No. 62/736,224, filed on Sep. 25, 2018.

(51) Int. Cl.
*F24F 13/14* (2006.01)
*F24F 11/56* (2018.01)

(52) U.S. Cl.
CPC ..... *F24F 13/1426* (2013.01); *F24F 11/56* (2018.01); *F24F 13/1486* (2013.01); *F24F 2013/1433* (2013.01)

(58) Field of Classification Search
CPC ..... F24F 13/1426; F24F 13/1486; F24F 13/1433; F24F 11/56
USPC ..... 454/363
See application file for complete search history.

(56) References Cited

U.S. PATENT DOCUMENTS

| | | | | |
|---|---|---|---|---|
| 5,096,156 | A | 3/1992 | Wylie et al. | |
| 7,188,481 | B2 * | 3/2007 | DeYoe | F24F 13/1426 62/186 |
| 9,835,354 | B2 * | 12/2017 | Yoskowitz | F16K 1/221 |
| 11,808,479 | B2 * | 11/2023 | Forman | F24F 13/1486 |

* cited by examiner

*Primary Examiner* — Steven B McAllister
*Assistant Examiner* — Charles R Brawner
(74) *Attorney, Agent, or Firm* — Simmons Perrine PLC

(57) ABSTRACT

An automatic remote controllable duct damper with an adjustable minimum flow through the duct, an adjustable maximum flow through the duct, which is configured so that an electric motor configured to adjust one of the adjustable maximum flow through the duct and the adjustable minimum flow through the duct is not configured to drive a damper plate in opposite directions and the amount of the adjustment of the adjustable maximum flow and the adjustable minimum flow is infinitely variable from said maximum flow to said minimum flow, without introducing any new matter within the interior of the duct.

8 Claims, 14 Drawing Sheets

ADJUSTABLE AUTOMATIC AIRFLOW CONTROL DAMPER SYSTEM

CROSS REFERENCE TO RELATED APPLICATIONS

The present application is a continuation application of the non-provisional application having the Ser. No. 16/433,785 filed on Jun. 6, 2019, which application claims the benefit of the filing date of provisional patent application having Ser. No. 62/736,224 filed on Sep. 25, 2018 by the same inventors, which applications are incorporated herein in their entirety by this reference.

BACKGROUND OF THE INVENTION

An airflow control damper is a valve that stops or regulates the flow of air in a duct or other air handling equipment. An airflow control damper can be used to stop or reduce flow of conditioned air to a room or section of a home or building, or to permit/deny a specific airflow stream to be introduced into a closed system. Airflow control dampers are often divided into two main categories; manual or automatic. Manual dampers may be actuated with the use of an exterior handle, while automatic dampers may be actuated by means of an electric or pneumatic device that supplies motive power to the damper valve. The motive power can be used to either exclusively open or close the damper, or to both open and close the damper. In a motorized or pneumatic actuated damper where the actuation is constant and occurs in only one direction, a mechanical storage device, such as a spring, is used to return the valve plate to the "normal" position in the absence of motive power. A damper such as this will be fully open or fully closed when powered or unpowered and is often the least expensive style of automatic damper for certain applications.

In a typical configuration, the damper uses a rotating shaft with a valve plate affixed to it. The rotation of the shaft determines the position of a valve plate. In turn, the position of the valve plate regulates the amount of resistance on the airflow through the damper. The position of the valve plate is changed according to the attached rod coupler that interfaces with the motivating power device. This coupler or means of coupling the motivating power to the damper plate is common in automatic dampers. A plate parallel to the airflow provides nearly unrestricted flow, while a plate position perpendicular to the flow maximizes restriction of the airflow through the damper. Plate positions other than these two extremes will result in flow consistent with the characteristics of the fluid, determined by the temperature and quality of the air. The position of the damper plate in relation to airflow is not linear; 20% open does not equate to 20% flow.

In some situations, it is desirable to adjust the damper so that it operates in positions other than fully closed or fully open. Manual dampers are sometimes equipped with locking mechanisms that indicate the position of the plate. This allows the user to adjust the airflow. Some automatic dampers also employ systems to adjust airflow based on the relative position of the valve plate. Moderately expensive adjustable automatic dampers use end-stops about the valve plate coupler to limit the positions. Like the inexpensive full-open/full-closed dampers, these types also utilize constant actuation with spring-return when un-powered. More expensive automatic dampers apply actuation in both directions and can also limit the plate position via end-stops. Some automatic dampers typically employ open or closed loop systems with stepper or brushless DC motors. These types offer proportional control via an 0-10V or 4-20 mA signal wire to maintain their plate position. This is often the most expensive option for automatic airflow control.

Problem:

Due to the variation in equipment and uniqueness of each HVAC or ventilation system, it is important for a general purpose automatic airflow control damper to be as versatile as possible. In some cases, it is important that the damper does not completely stop the flow of air when closed, as this condition can cause damage to a blower system; especially if the damper is acting in conjunction with others. Alternatively, it is sometimes beneficial to restrict some airflow in the "open" state to properly balance a system.

There are currently damper systems on the market that satisfy system variables, however these systems are often expensive and complicated putting them out of reach for the average home or building owner.

SUMMARY OF THE INVENTION

It is an object of the present invention to provide a versatile general purpose duct damper which is capable of meeting many different types of needs.

It is a feature of the present invention for the coupler assembly to enable switching a normally open configuration to a normally closed configuration.

It is an advantage to provide a retail general purpose duct damper with a single SKU which is easily configurable to be used in a wide variety of applications.

Accordingly the present invention is a remote controlled adjustable duct damper comprising:

- a duct, having an interior and an exterior;
- a damper plate, disposed within said duct and configured to move so as to regulate the fluid flow through said duct;
- a damper plate elongated member, extending from said interior to said exterior and coupled to said damper plate, configured to move said damper plate when said damper plate elongated member is moved;
- an adjustable means, disposed in said exterior, for regulating permissible positions of said damper plate, to variably control one of a maximum fluid flow and a minimum fluid flow through said duct; and
- wherein said adjustable means lacks an ability to electrically drive movement of the damper plate in opposing directions.

Additionally the present invention is the remote controlled adjustable duct damper comprising:

- a duct, having an interior and an exterior;
- a damper plate, disposed within said duct and configured to move so as to regulate the fluid flow through said duct;
- a damper plate shaft, extending from said interior to said exterior and coupled to said damper plate, configured to rotate said damper plate when said damper plate shaft is rotated;
- a coupler configured to couple to said damper plate shaft at an infinite number of different locations about a damper shaft axis;
- an outer ring disposed around a portion of said coupler which extends distally of said damper plate; said outer ring having an orifice therethrough for receiving a self-tapping screw, which when advanced through said orifice can engage a portion of said coupler;
- said coupler having fixed thereon a coupler engaging arm;

said outer ring having fixed thereon an outer ring engaging arm; and said coupler engaging arm and said outer ring engaging arm being capable of a mutual alignment configuration such that rotation of said outer ring in one direction results in a limitation on a maximum flow amount through said duct and a rotation in an opposite direction results in a limitation on a minimum flow rate through said duct.

DETAILED DESCRIPTION OF THE DRAWINGS

Figure 1:
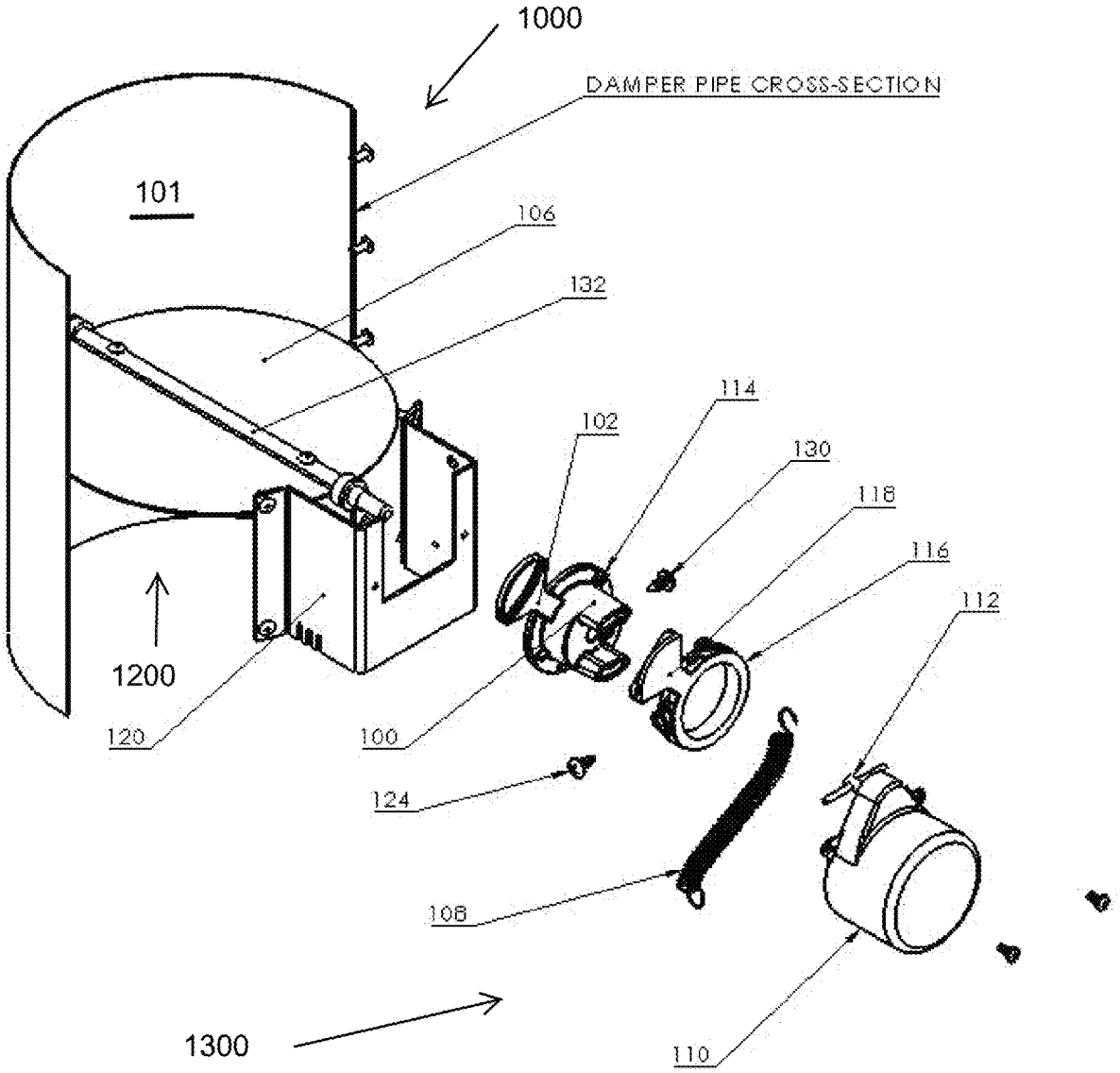
FIG. 1 is a partially exploded view of the present invention where a portion of the damper duct 101 is removed and control system 1300 is exploded, unadjusted for closing and/or opening stops and in an unpowered state.

Now referring to the drawings, wherein like numerals refer to like matter throughout and more particularly referring to FIG. 1, there is shown one embodiment of the automatic adjustable damper system 1000 of the present invention which is low cost and versatile. It incorporates two mechanical stops to be used for limiting open and closed positions, the damper can be changed from normally open to normally closed (the position when the motor is de-energized), the system is easy to use and understand, and uses reliable low-cost components. All of the figures show a normally open configuration, but rotating the damper plate (106) 90 degrees with respect to the inner coupler can result in the present invention being in a normally closed configuration.

Figure 2:
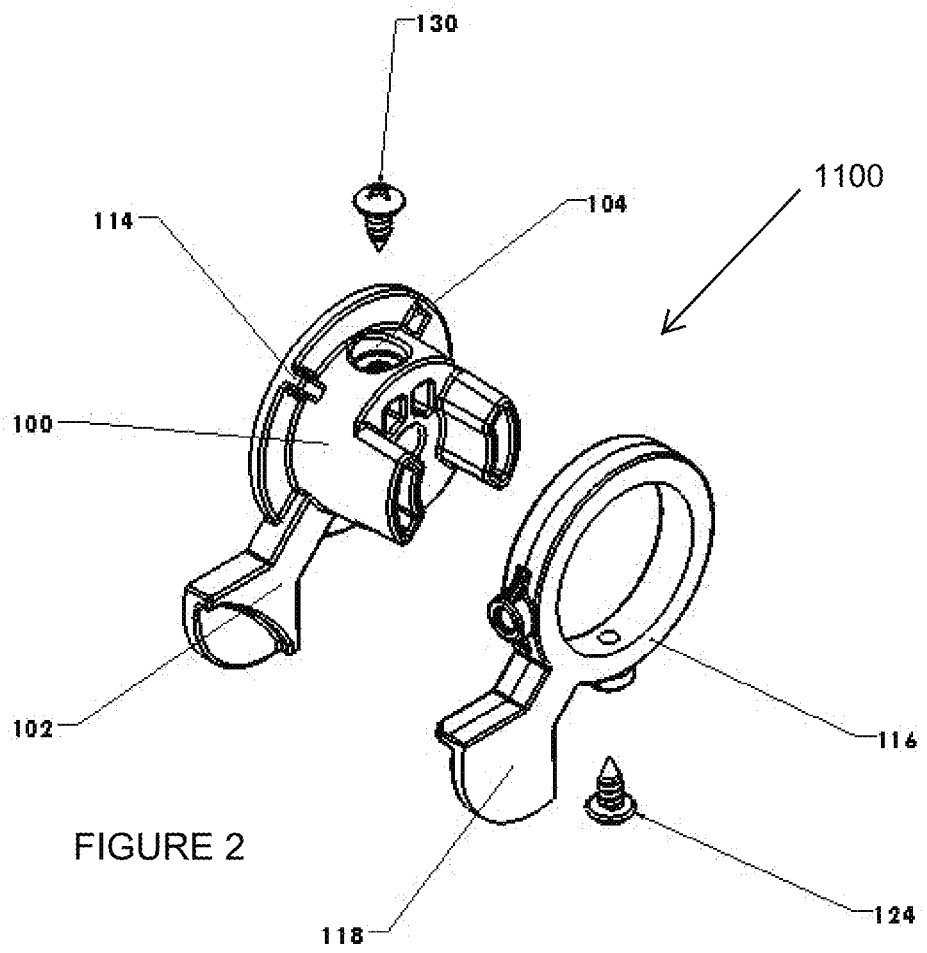
FIG. 2 is an exploded view of the coupler assembly 1100.

The present invention is made up of a sheet metal damper 1200 and a control system 1300. The sheet metal damper 1200 comprises a damper duct 101, a damper plate 106 and a damper plate shaft 132. The control system 1300 comprises a motor bracket 120, a two-part coupler 1100, extension spring 108, motor 110, and screws 124 and 130. See FIG. 1. The coupler assembly 1100 comprises the coupler 100 with inner arm 102 and the adjustable outer ring 116 with arm 118. See FIG. 2. The coupler assembly 1100 serves the function of a traditional coupler with several additional features:

1. It includes a fixed inner arm 102 integral to the coupler 100, which can be used to limit rotation.
2. The coupler 100 has a counter bore 104 (recesses) to accept a standard screw (in this case a self-tapping, sheet metal screw). This allows for easy release and repositioning of the fixed inner arm 102 relative to the damper plate 106.
3. After being back driven by the return spring 108, the coupler 100 allows the motor 110 to rotate freely and stop naturally. (Motors with reduction gears develop inertia due to the mass of the rotating parts. Damage may result if the motor shaft 112 is not allowed to slow before stopping.)
4. It incorporates an anchor point 114 for the attachment of a return spring 108.
5. The coupler 100 is designed to accept an additional adjustable outer ring 116 with arm 118 that is used to limit rotation.
6. The inner 102 and outer 118 arms of the coupler 100 can be used in conjunction to adjust the plate 106 position.
7. Adjustable damper stops can be disposed within the motor bracket 120.

The adjustable outer arm 118 is designed as a ring 116 on one end that fits around the coupler 100. The ring 116 has two screw bosses that can accept a self-tapping screw 124. The adjustable outer ring 116 slides onto the coupler 100 and is rotated into position. Once in the desired position, the self-tapping screw 124 is used to affix the outer adjustable arm 118 to the coupler 100.

A hysteresis motor 110 with integrated gear reduction is used. It is mounted to a motor bracket 120 that is also used to attach one end of an extension spring 108. The other end of the extension spring 108 is attached to the coupler 100 and exerts a force opposed to the rotation of the energized motor 110. When de-energized the motor 110 is back driven by the spring 108. This de-energized position is considered the "normal" or "return" position since it is the position the damper will be in when unpowered.

Figure 3:
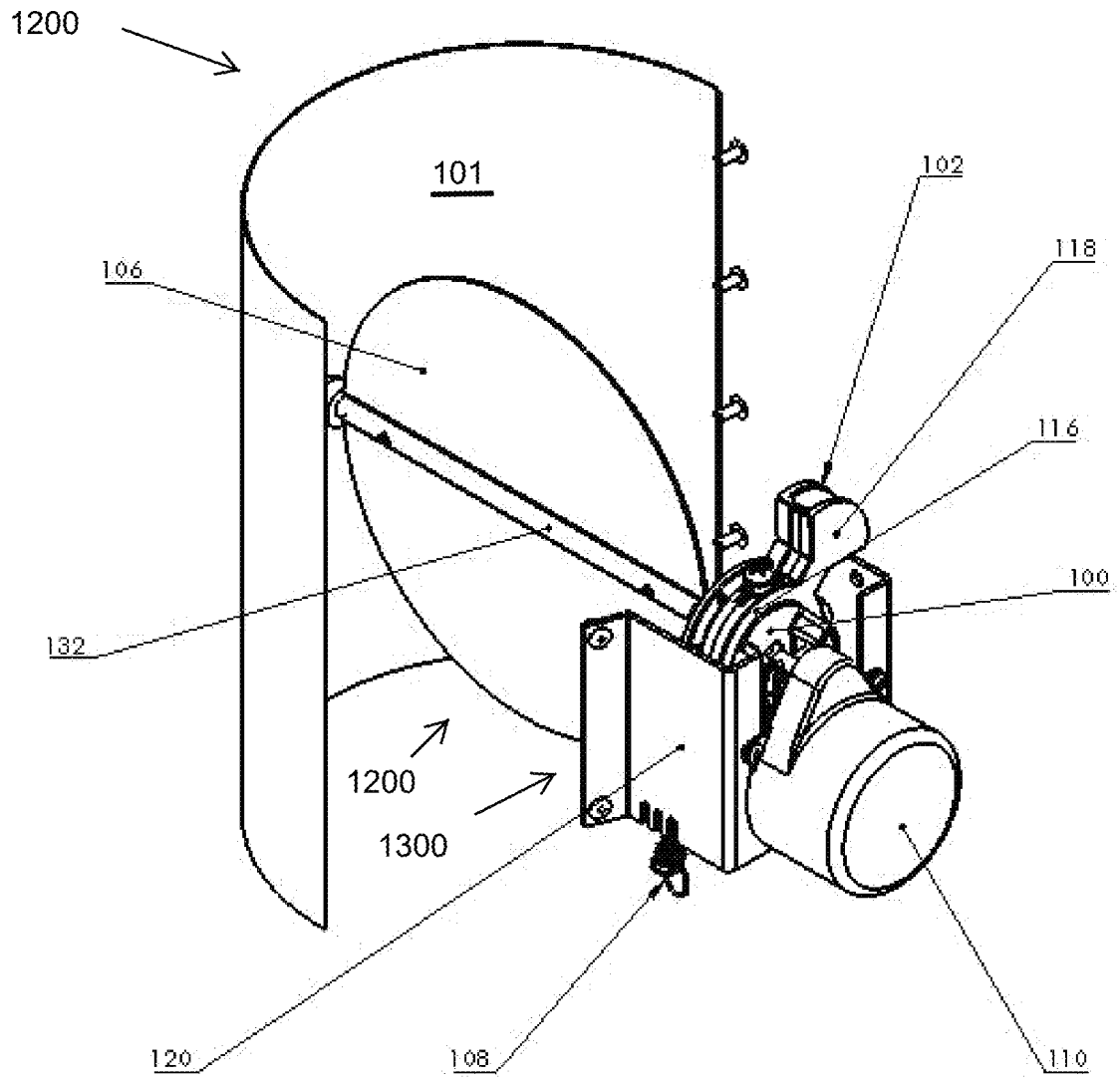
FIG. 3 is a non-exploded view of the system of FIG. 1 in an unpowered state.
Figure 4:
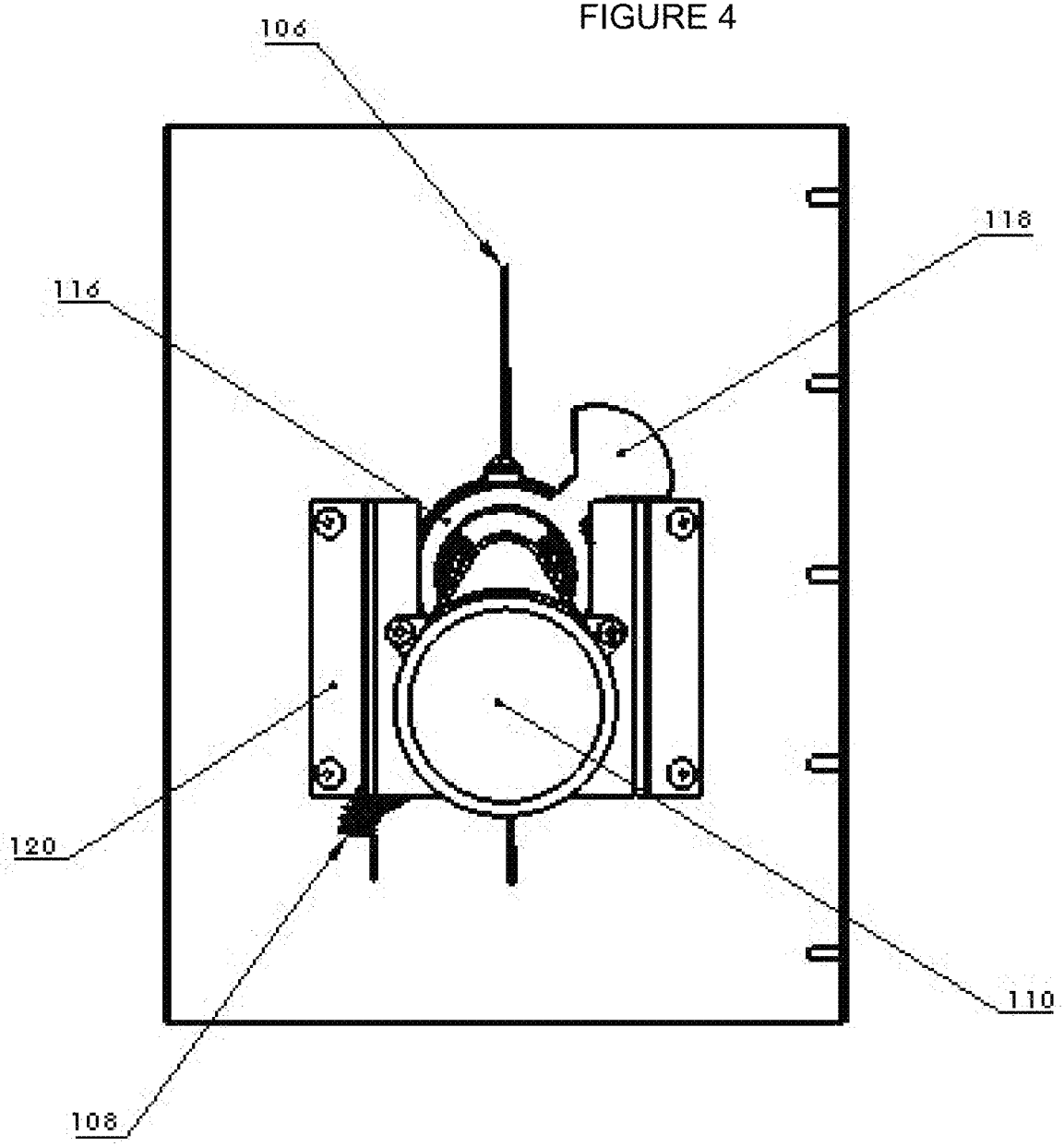
FIG. 4 is a side view of the system of FIG. 3.
Figure 5:
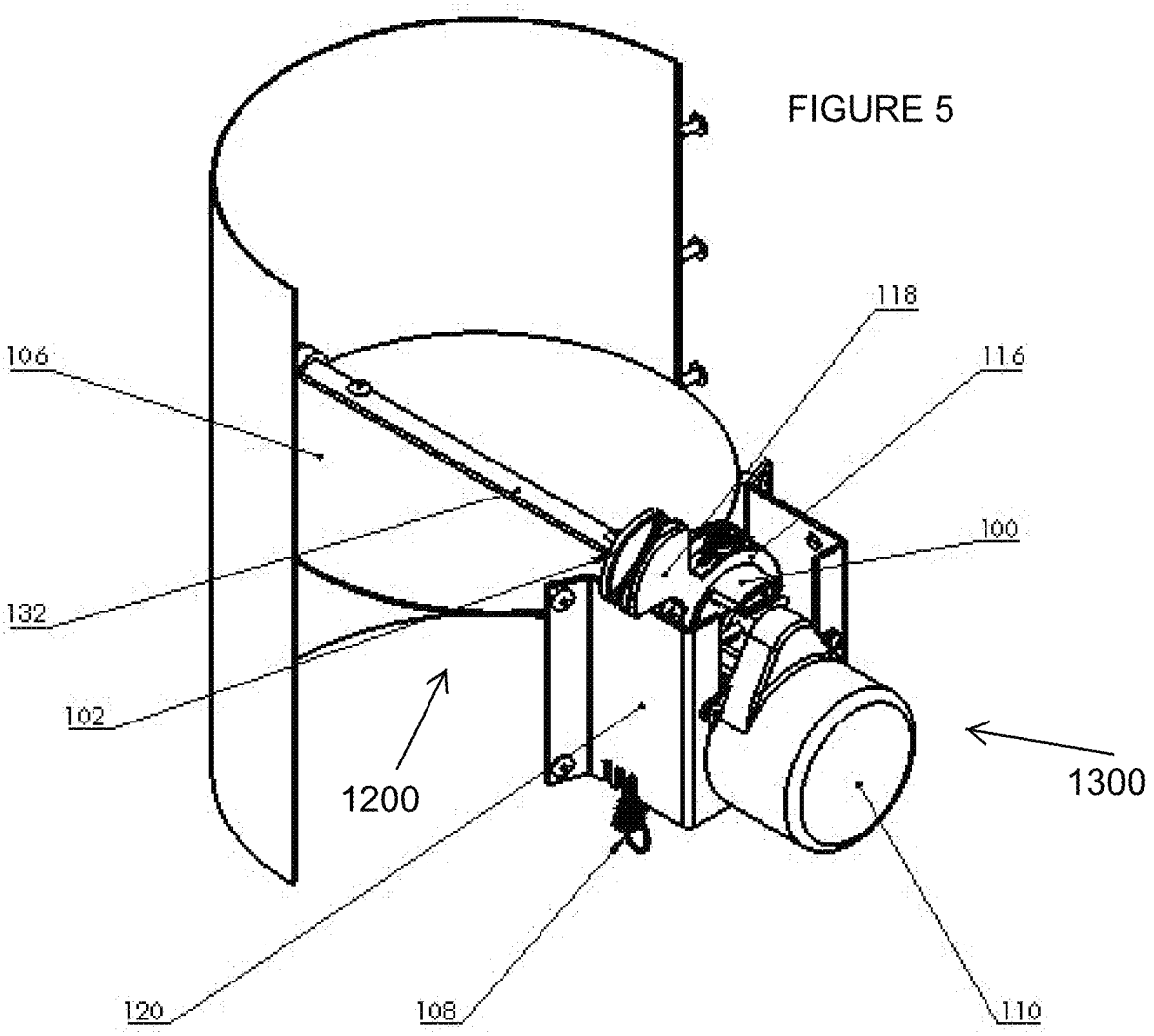
FIG. 5 is a system of FIG. 3 in a fully powered state.
Figure 6:
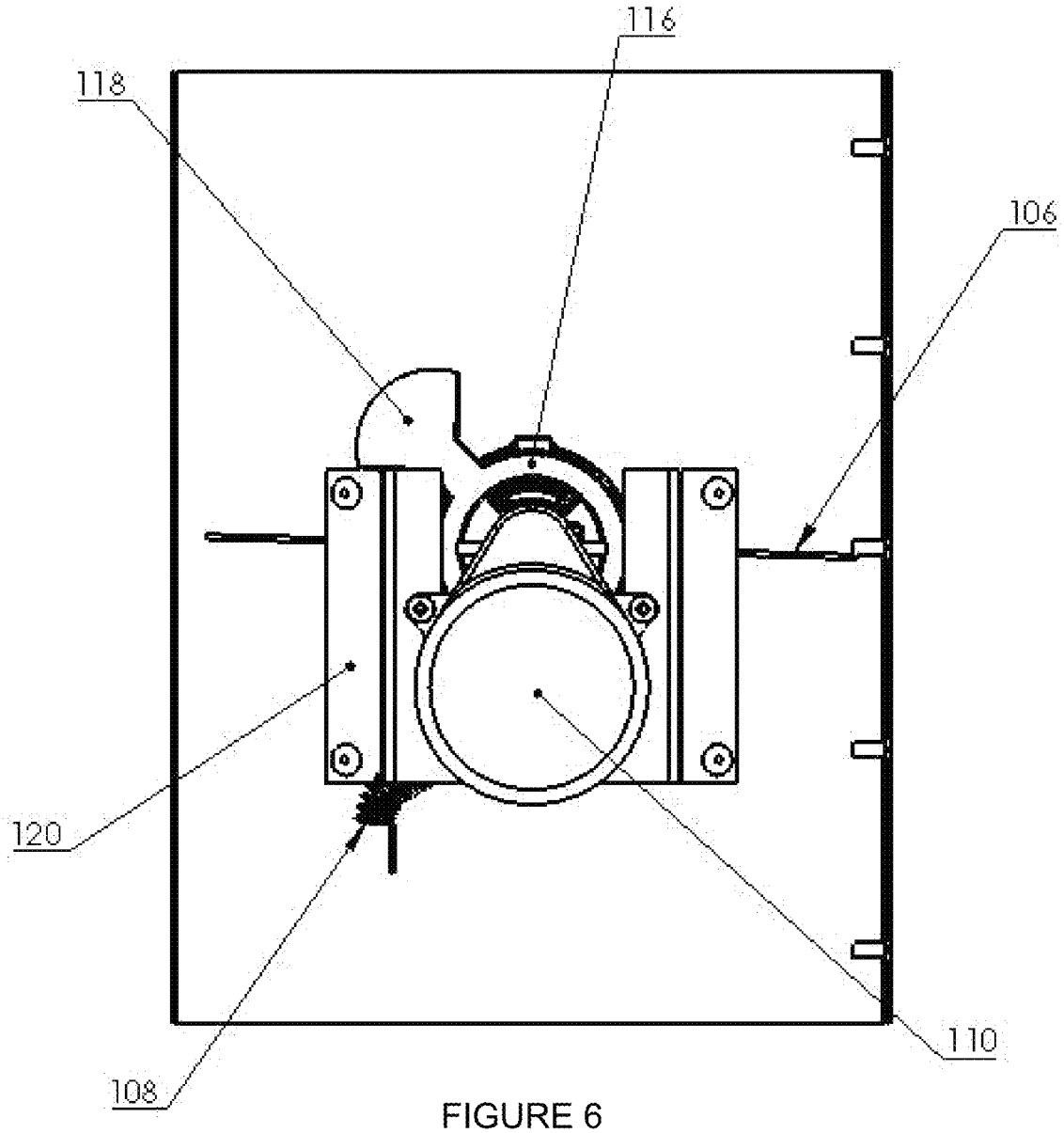
FIG. 6 is a side view of the system of FIG. 5.
Figure 7:
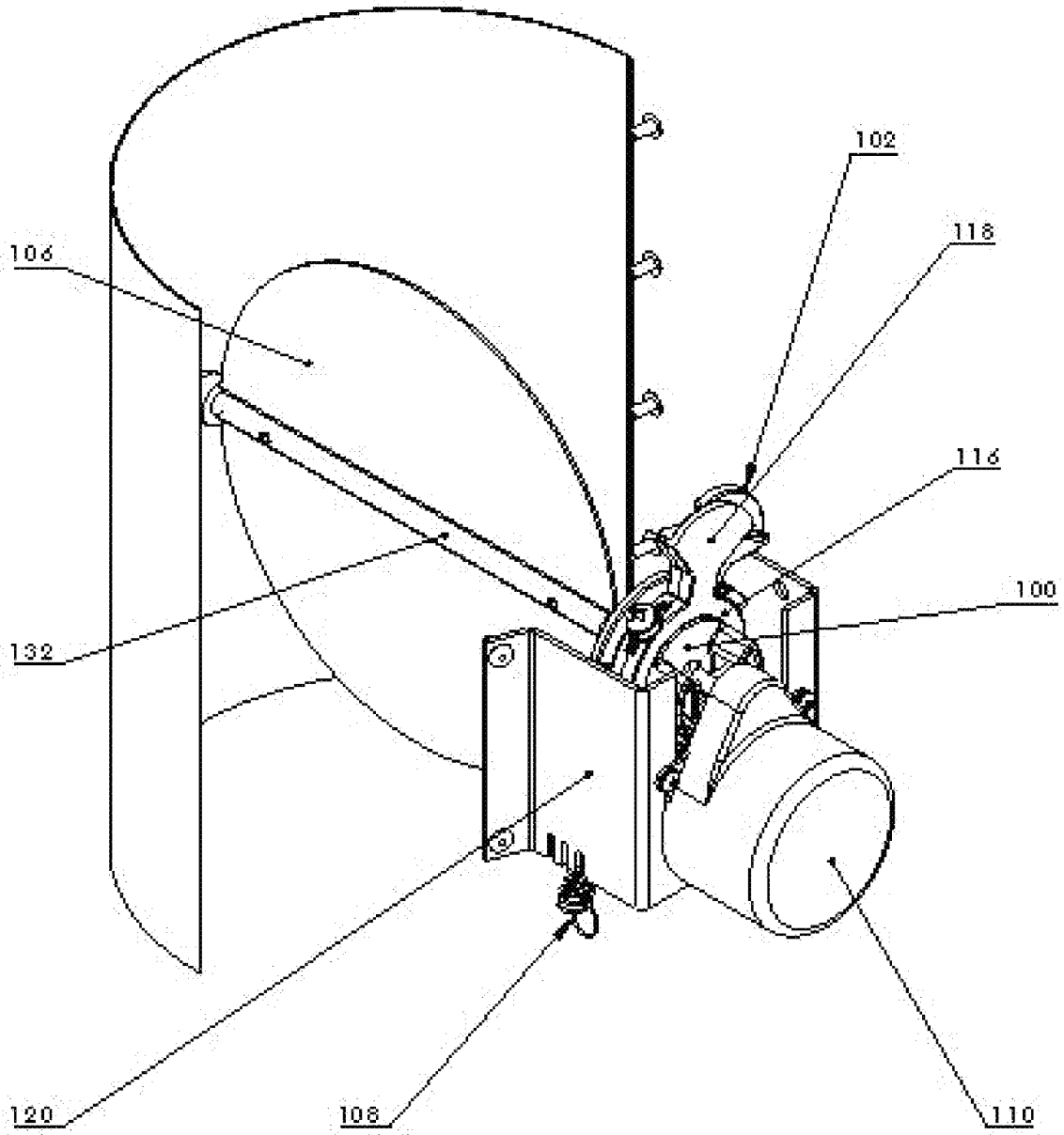
FIG. 7 is a view of the present invention with a closing stop adjustment in an unpowered state in a normally open configuration.
Figure 8:
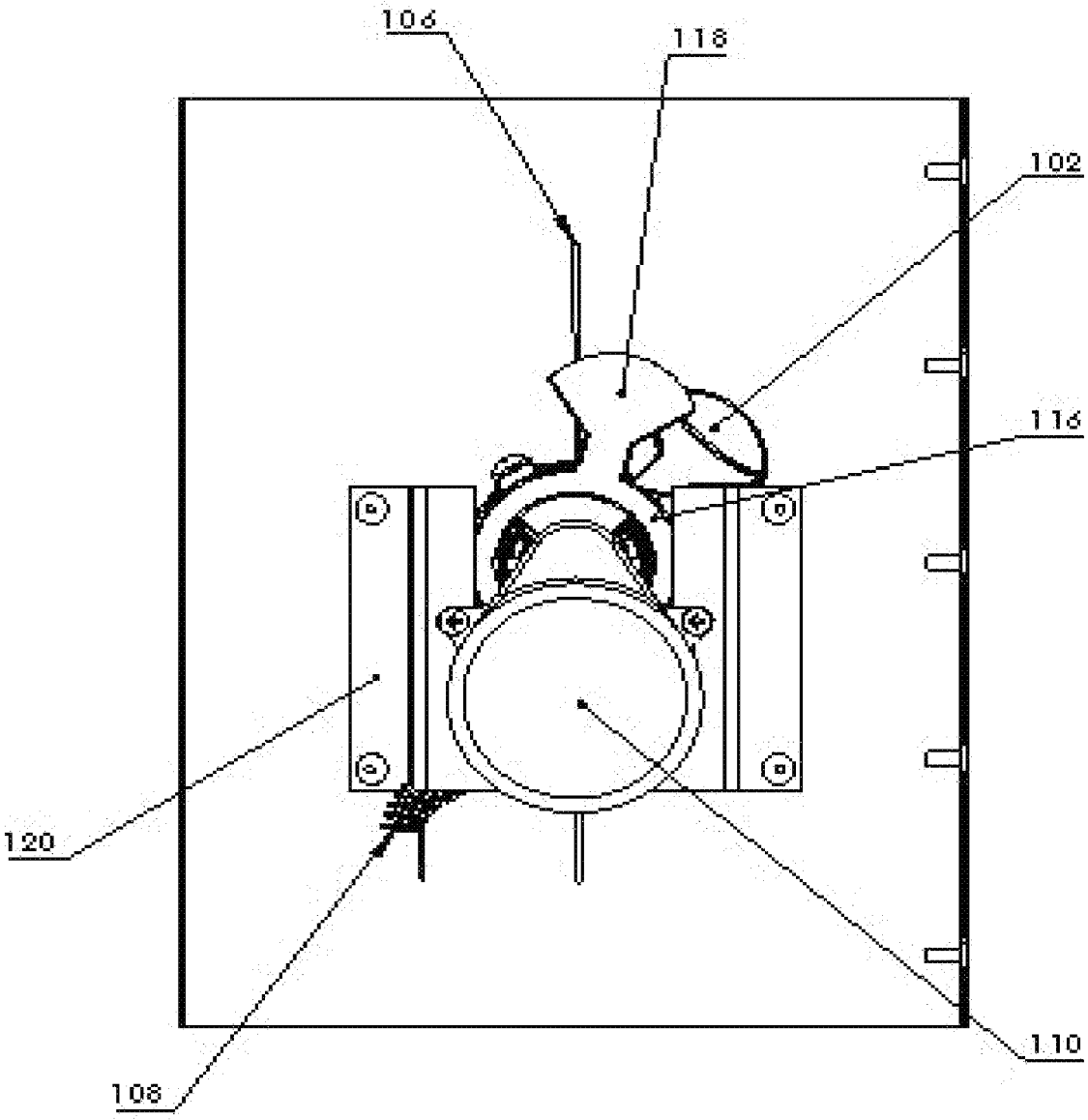
FIG. 8 is a side view of the system of FIG. 7.
Figure 9:
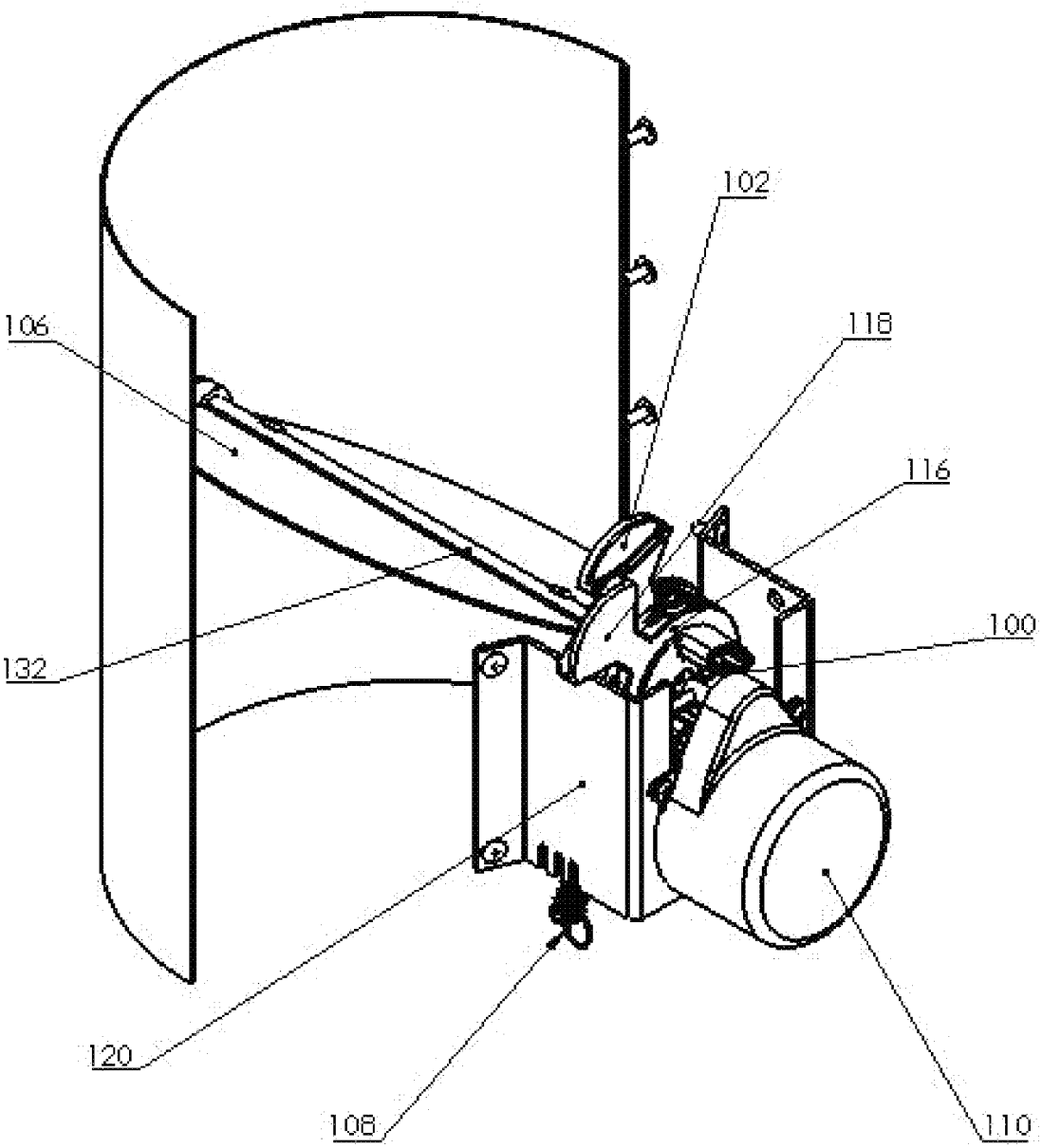
FIG. 9 is a view of the system of FIGS. 7 and 8 except in a powered state.
Figure 10:
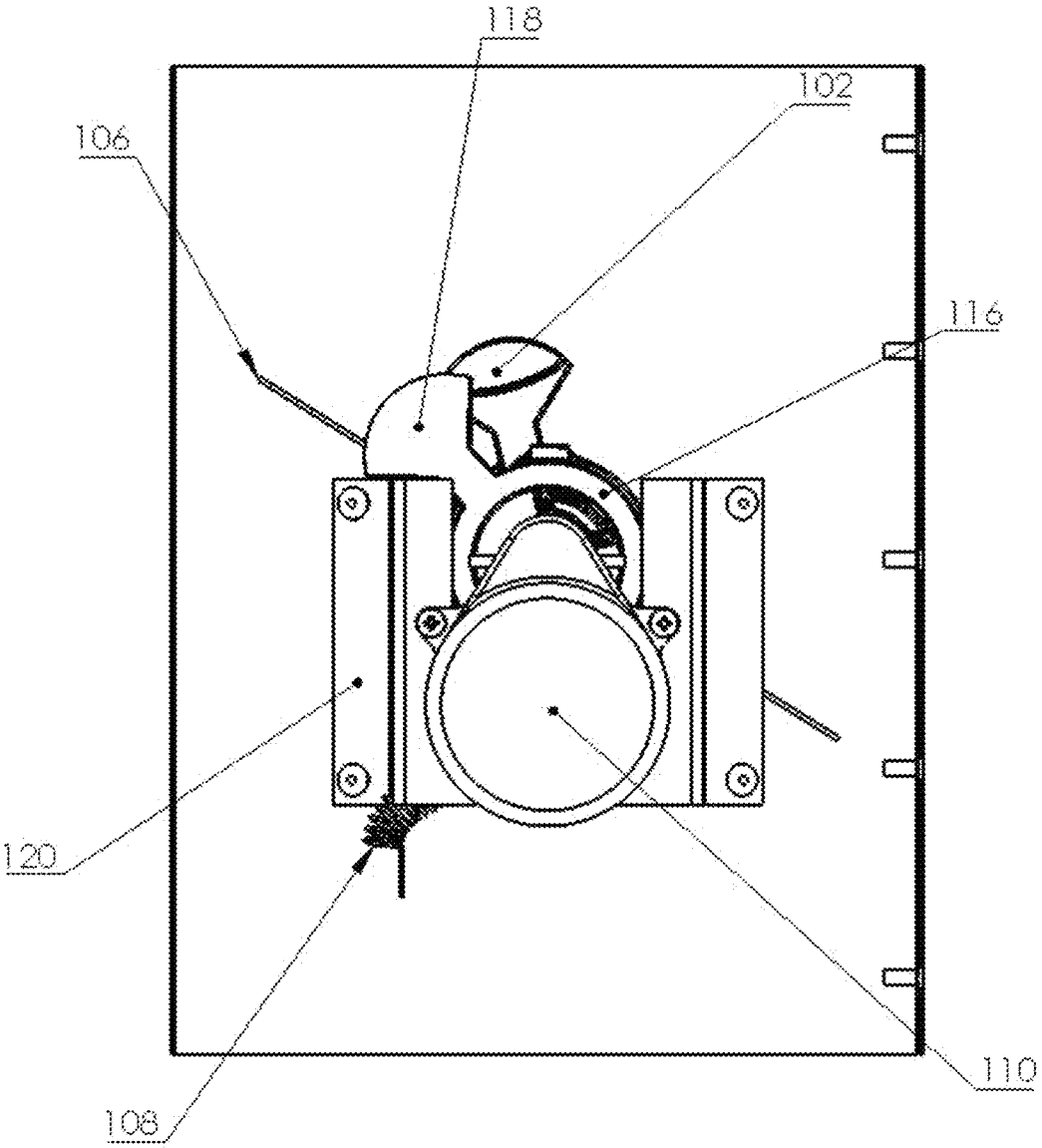
FIG. 10 is a side view of the system of FIG. 9.
Figure 11:
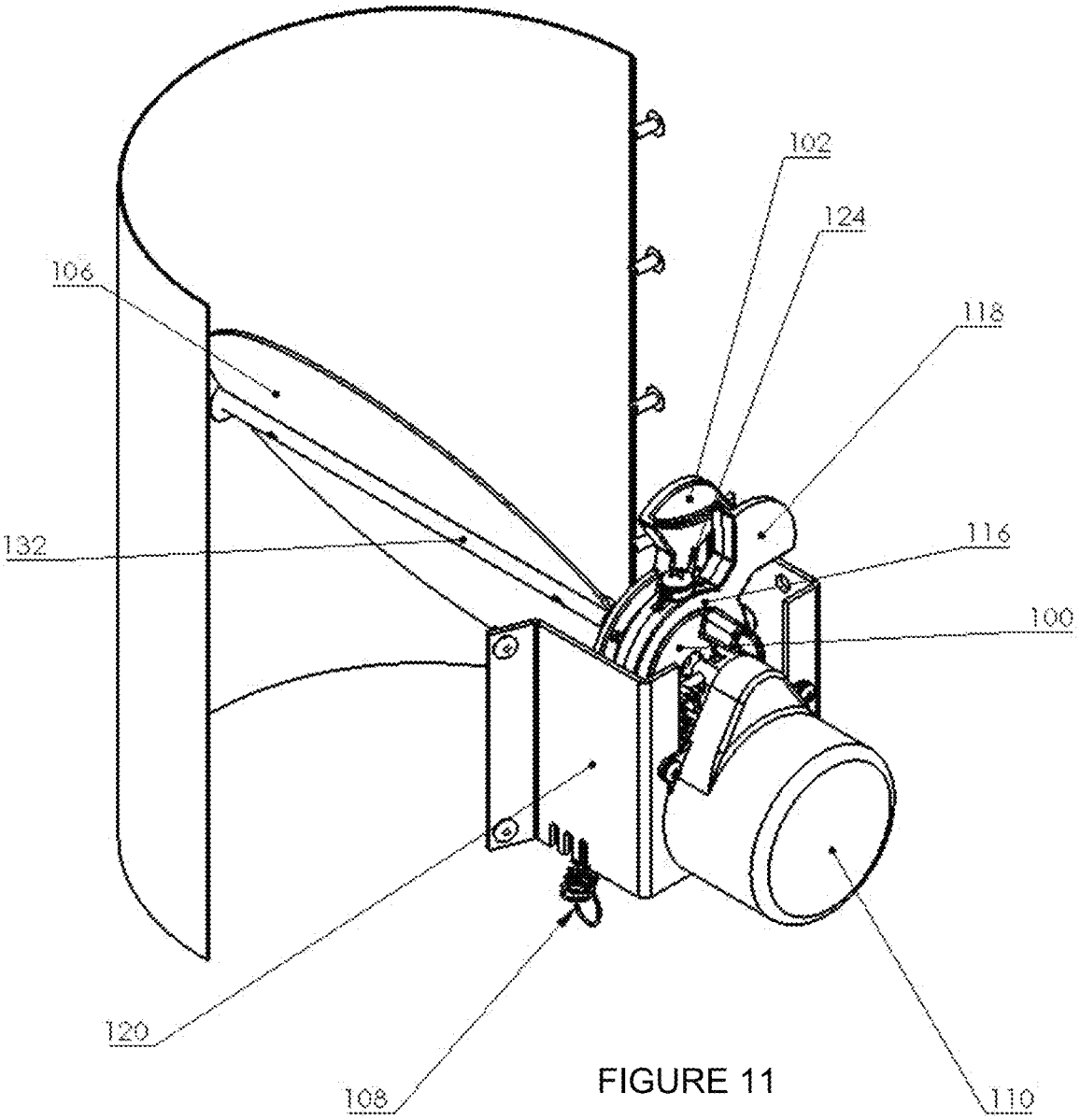
FIG. 11 is a view of the present invention with an opening stop adjustment in an unpowered state in a normally open configuration.
Figure 12:
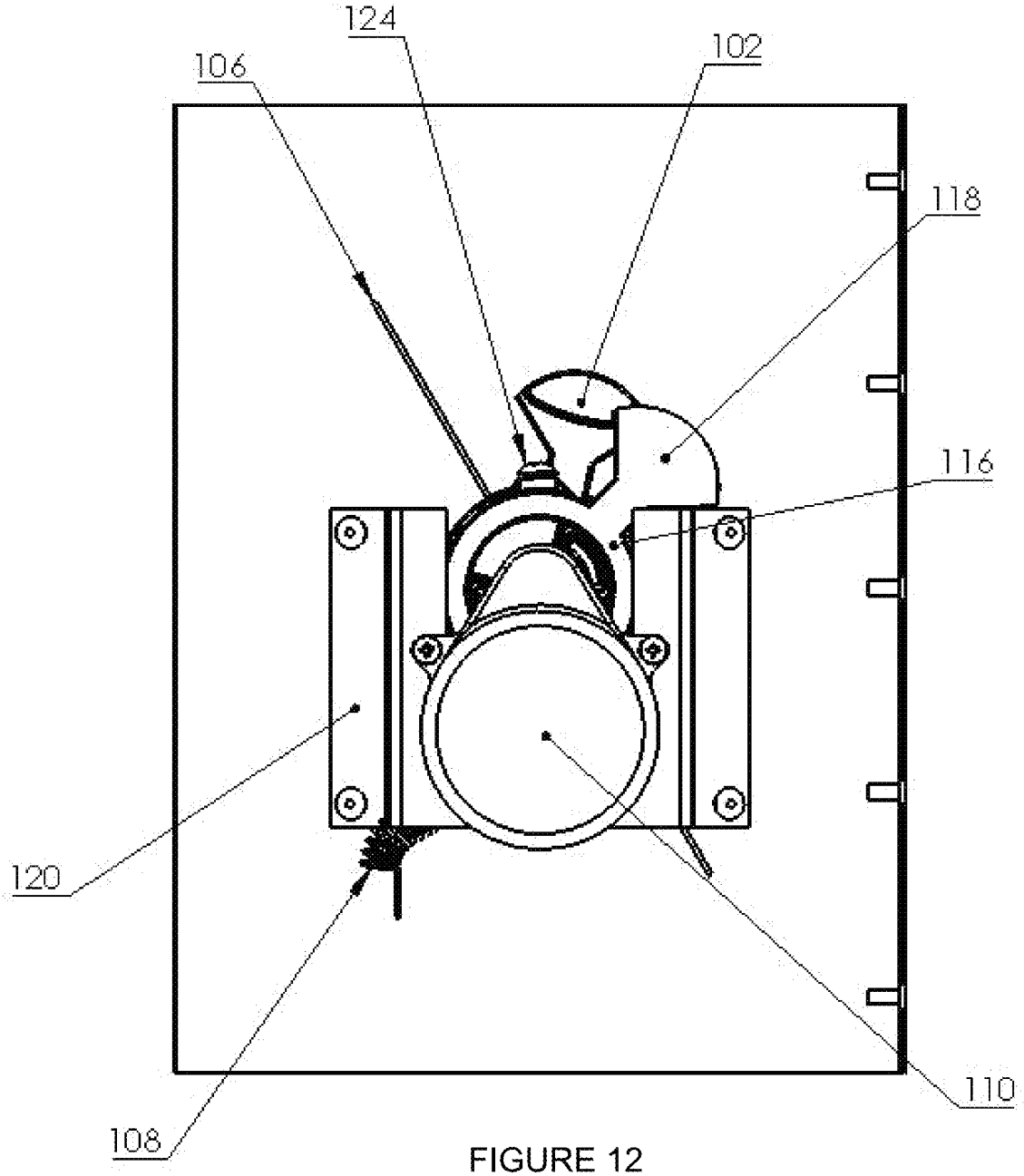
FIG. 12 is a side view of system of FIG. 11.
Figure 13:
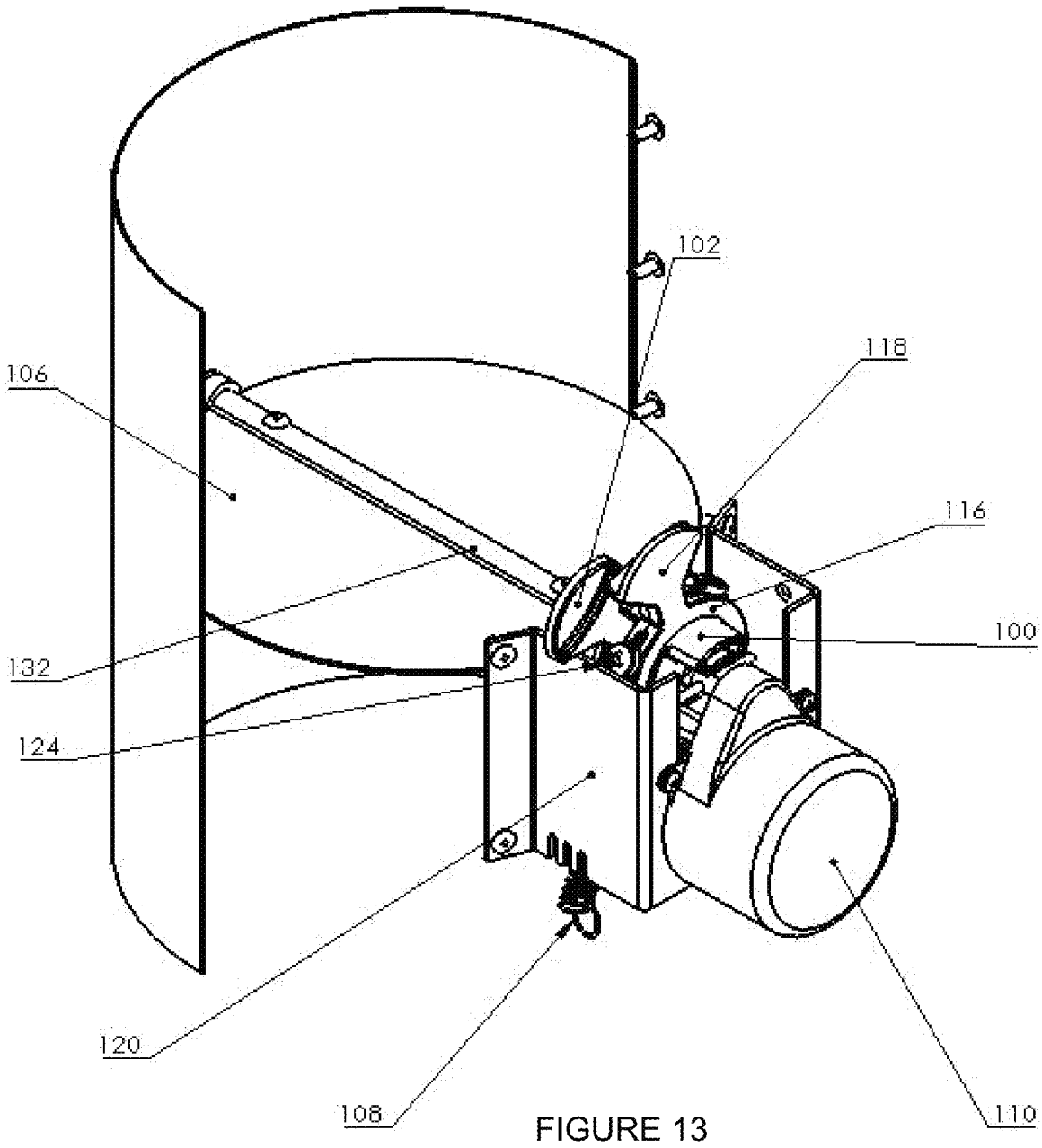
FIG. 13 is a view of the system of FIGS. 11 and 12 except in a powered state.
Figure 14:
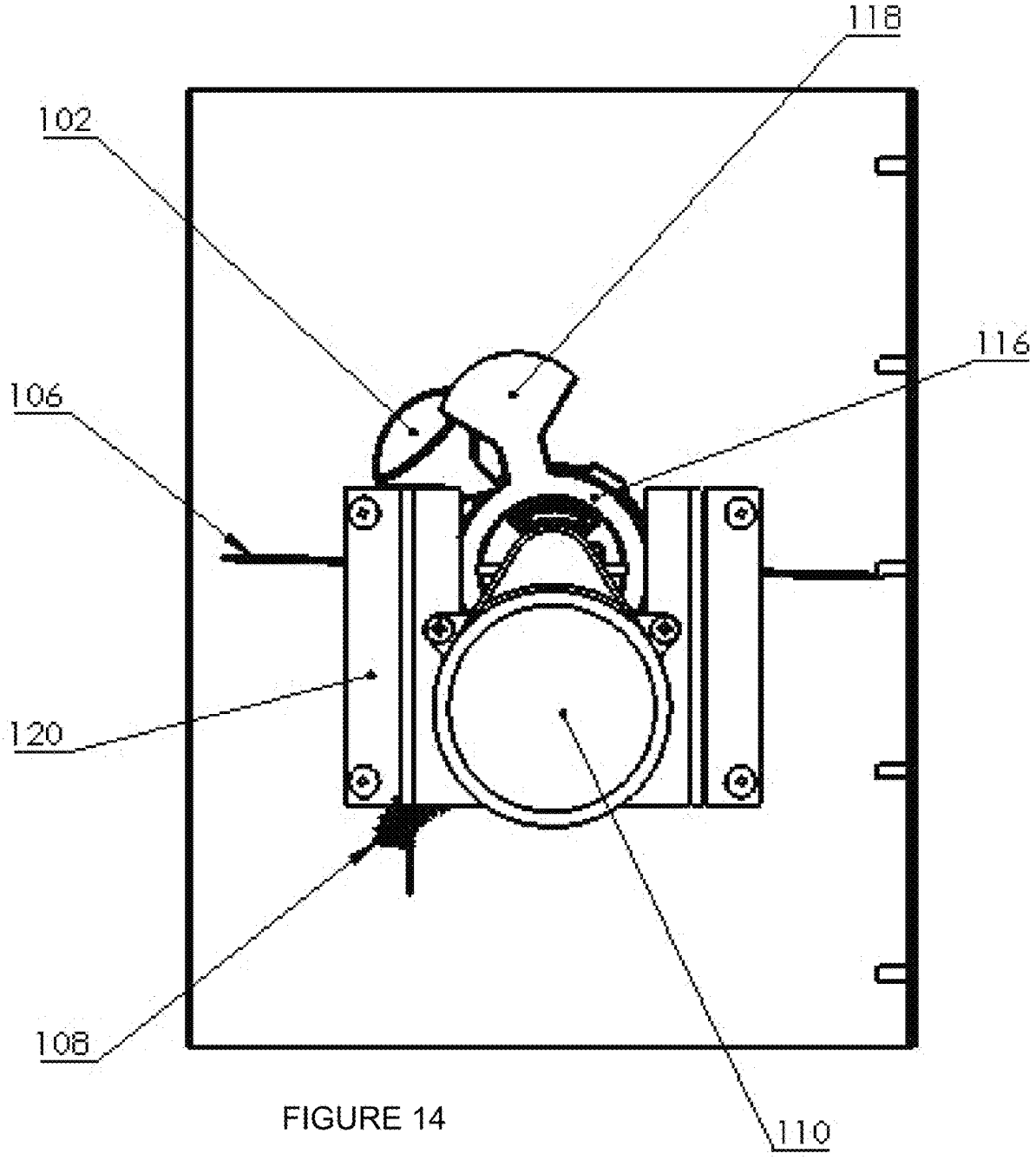
FIG. 14 is a side view of the system of FIG. 13.

The standard arrangement for the damper is to be open when the motor 110 is not energized (normally open). When the inner arm 102 on the coupler 100 and the adjustable outer arm 118 are aligned, the damper will act as a traditional two-position damper; open will be parallel to the air flow (100% open), see FIGS. 3 and 4, and closed (powered) will be perpendicular to the flow of air (100% closed). See FIGS. 5 and 6. Adjustment to the open and closed position is accomplished by loosening the screw 124 fastening the adjustable outer arm 118 to the coupler 100. Rotating the outer adjustment arm 118 counterclockwise reduces the amount by which the damper rotates, or closes. For example, a thirty-degree counterclockwise rotation of the outer adjustment arm 118 will result in the damper plate 106 rotating sixty-degrees when the motor 110 is energized. The damper will be fully open in the unpowered position, see FIGS. 7-8, and will be open thirty-degrees when in the closed (powered) position. See FIGS. 9 and 10. Conversely, a thirty-degree clockwise rotation of the outer adjustment arm 118 will result in the damper plate 106 being positioned at thirty-degrees from the direction of air flow, or sixty-degrees from the closed position. The damper plate 106 will rotate sixty-degrees to fully closed when the motor 110 is energized, see FIGS. 13-14, and will rotate back sixty-degrees on the return. See FIGS. 11 and 12. Note the total amount of rotation is reduced by thirty-degrees, and that the maximum amount of rotation possible is ninety-degrees.

Alternatively, the damper can also be adjusted to operate as normally closed (closed when the motor is de-energized), this is done by loosening the outer adjustment arm 118 and sliding it forward to expose the screw 130 fastening the coupler 100 to the damper plate shaft 132. This screw 130 is then loosened and, while keeping the inner coupler arm in the same position (relative to the motor 110 and bracket 120), the damper plate shaft 132 is rotated 90 degrees to the desired position. The coupler screw 130 is then tightened; outer adjustment arm 118 is slid back into place, positioned, and fastened to the coupler. The adjustments to either the powered or unpowered position are as described above for the normally-open damper, but reversed.

An additional benefit of this method is that in the event the outer adjustment arm is misplaced or otherwise damaged/loose, the damper will "fail-safe" as a standard full-open, full-closed automatic damper.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred and/or exemplary embodiment thereof.

We claim:

1. An adjustable duct damper comprising:

a duct, having an interior and an exterior;

a damper plate, disposed within said duct and configured to move so as to regulate fluid flow through said duct;

a damper plate elongated member, extending from said interior to said exterior and coupled to said damper plate, configured to move said damper plate, through at least three positions when said damper plate elongated member is moved;

a spring configured to move said damper plate in one direction;

an adjustable means, for regulating positions of said damper plate, to control one of a maximum fluid flow and a minimum fluid flow through said duct; and wherein said adjustable means comprises a first member which adjustably limits movement of said damper plate elongated member wherein said first member can be adjusted so as to result in a flow rate between said maximum fluid flow and said minimum fluid flow;

a second member; where both of said first member and said second member are configured to move with respect to said elongated member;

a first fastener; and a second fastener; where said first fastener selectively couples one of said first member and said second member to said elongated member and said second fastener selectively couples said first member and said second member;

wherein said first member and said second member are positioned and configured so that contact with any portion of said first member or said second member with a portion of a bracket disposed on said exterior, results in limiting movement of said damper plate elongated member and therefore limits movement of said damper plate;

said damper plate elongated member being configured for an adjustment with respect to one of said damper plate and said adjustable means, so that said spring can be used to cause said damper plate to be in a different one of each of a normally open and a normally closed configuration before and after said adjustment is made;

wherein said damper plate elongated member is coupled to said damper plate; and wherein said adjustable means has an ability to electrically drive movement of the damper plate through at least three positions in a first direction.

2. The adjustable duct damper of claim 1 wherein the spring is coupled between said first member and a portion of said bracket so that said damper plate is in one of a normally open and a normally closed configuration.

3. The adjustable duct damper of claim 2 wherein said damper plate is substantially circular and said damper plate elongated member is transversely disposed across said damper plate along a line through a center of said damper plate.

4. The adjustable duct damper of claim 3 wherein a first member adjustably limits rotation of said damper plate elongated member; and wherein said first member can be adjusted to an infinite number of configurations which result in fluid flow rates between said maximum fluid flow and said minimum fluid flow.

5. The adjustable duct damper of claim 4 wherein said first fastener is a first semi-permanent fastener to be held in place with respect to said second member, both of which are configured to rotate around a central axis of said damper plate elongated member.

6. The adjustable duct damper of claim 5 wherein said second fastener is a second semi-permanent fastener.

7. The adjustable duct damper of claim 6 wherein said first member and said second member are positioned and configured so that contact with any portion of said first member or said second member with a portion of a bracket disposed on said exterior, results in limiting rotation of said damper plate elongated member and therefore limits rotation of said damper plate; and wherein said first member is proximal to said damper plate and said second member is disposed about a portion of said first member extending distally of said damper plate.

8. The adjustable duct damper of claim 7 wherein a spring is coupled between said first member and a portion of said bracket so that said damper plate is in one of a normally open and a normally closed configuration.

* * * * *